US011261675B2

(12) United States Patent
Allen

(10) Patent No.: US 11,261,675 B2
(45) Date of Patent: Mar. 1, 2022

(54) METHODS FOR CONSTRUCTING A HELICAL STRAKE SEGMENT USING ONE OR MORE SHELL SECTIONS AND FINS

(71) Applicant: VIV Solutions LLC, Richmond, TX (US)

(72) Inventor: Donald Wayne Allen, Richmond, TX (US)

(73) Assignee: VIV SOLUTIONS LLC, Richmond, TX (US)

( * ) Notice: Subject to any disclaimer, the term of this patent is extended or adjusted under 35 U.S.C. 154(b) by 0 days.

(21) Appl. No.: 16/249,329

(22) Filed: Jan. 16, 2019

(65) Prior Publication Data

US 2019/0218866 A1 Jul. 18, 2019

Related U.S. Application Data

(60) Provisional application No. 62/618,046, filed on Jan. 16, 2018.

(51) Int. Cl.

| | |
|---|---|
| ***F16L 57/00*** | (2006.01) |
| ***F15D 1/10*** | (2006.01) |
| ***F16L 1/12*** | (2006.01) |
| ***E02B 17/00*** | (2006.01) |
| ***E21B 17/22*** | (2006.01) |
| ***E21B 17/01*** | (2006.01) |

(52) U.S. Cl.
CPC ..... *E21B 17/22* (2013.01); *E21B 17/01* (2013.01)

(58) Field of Classification Search
None
See application file for complete search history.

(56) References Cited

U.S. PATENT DOCUMENTS

| | | | |
|---|---|---|---|
| 879,586 | A | 2/1908 | Reynolds |
| 890,125 | A | 6/1908 | Crampton |
| 2,401,783 | A | 6/1946 | Wilcoxon |
| 3,163,221 | A | 12/1964 | Shatto |

(Continued)

FOREIGN PATENT DOCUMENTS

| | | | |
|---|---|---|---|
| EP | 2525123 | A1 | 11/2012 |
| GB | 2335248 | A | 9/1999 |

(Continued)

OTHER PUBLICATIONS

Allen, D.W. et al., "Henning Devices: A New Class of VIV Suppression Apparatus for Offshore Tubulars", Offshore Technology Conference 19881, May 4-7, 2009, pp. 1-9.

(Continued)

*Primary Examiner* — Matthew Troutman
*Assistant Examiner* — Douglas S Wood
(74) *Attorney, Agent, or Firm* — Womble Bond Dickinson (US) LLP

(57) ABSTRACT

A helical strake for suppressing a vortex induced vibration (VIV) of a tubular. The helical strake having a shell dimensioned to at least partially encircle an underlying tubular, the shell having at least one fin opening; and at least one fin dimensioned to be positioned within the at least one fin opening formed by the shell, the at least one fin having a base portion dimensioned to be positioned along an underlying tubular and a tail portion dimensioned to extend through the at least one fin opening and radially outward from an underlying tubular.

14 Claims, 10 Drawing Sheets

(56) References Cited

U.S. PATENT DOCUMENTS 3,176,646 A 4/1965 Natwick et al.
3,194,204 A 7/1965 Nichols et al.
3,248,886 A 5/1966 Blenkarn
3,321,924 A 5/1967 Liddell
3,343,515 A 9/1967 Nichols
3,454,051 A 7/1969 Goepfert et al.
3,472,196 A 10/1969 Ewing et al.
3,557,840 A 1/1971 Maybee
3,611,976 A 10/1971 Hale
3,671,348 A 6/1972 Kemsey-Bourne
3,962,982 A 6/1976 Marchay
4,033,279 A 7/1977 Stiles
4,116,015 A 9/1978 Duncan
4,365,574 A 12/1982 Normington
4,398,487 A 8/1983 Ortloff et al.
4,474,129 A 10/1984 Watkins et al.
4,505,617 A 3/1985 Miller et al.
4,567,841 A 2/1986 Hale
4,640,673 A 2/1987 Takeda et al.
4,657,116 A 4/1987 Gardner et al.
4,700,651 A 10/1987 Hale
4,705,331 A 11/1987 Britton
4,722,367 A * 2/1988 Swink ..... F15D 1/10 138/178
4,832,530 A 5/1989 Andersen et al.
5,050,445 A 9/1991 Duffy
5,335,620 A 8/1994 Small
5,421,413 A 6/1995 Allen et al.
5,456,199 A 10/1995 Kernkamp
5,722,340 A 3/1998 Sweetman
5,845,827 A 12/1998 Reising
5,869,159 A 2/1999 Padilla
6,019,549 A 2/2000 Blair et al.
6,048,136 A 4/2000 Denison et al.
6,067,922 A 5/2000 Denison et al.
6,347,911 B1 * 2/2002 Blair ..... E01D 19/02 24/462
6,401,646 B1 6/2002 Masters et al.
6,561,734 B1 5/2003 Allen et al.
6,565,287 B2 5/2003 McMillan et al.
6,685,394 B1 2/2004 Allen et al.
6,695,539 B2 2/2004 McMillan et al.
6,695,540 B1 2/2004 Taquino
6,702,026 B2 3/2004 Allen et al.
6,755,595 B2 6/2004 Oram
6,789,578 B2 9/2004 Latham et al.
6,896,447 B1 5/2005 Taquino
6,928,709 B2 8/2005 McMillan et al.
6,971,413 B2 12/2005 Taylor et al.
6,994,492 B2 2/2006 McMillan et al.
7,017,666 B1 3/2006 Allen et al.
7,147,402 B2 * 12/2006 Edfeldt ..... F16L 1/123 405/159
7,458,752 B2 12/2008 Esselbrugge et al.
7,485,801 B1 2/2009 Pulter et al.
7,578,038 B2 8/2009 McMillan et al.
7,600,945 B2 10/2009 Burgess
7,674,074 B2 3/2010 Masters et al.
7,766,580 B2 8/2010 Dartford et al.
7,842,396 B2 11/2010 White
7,845,299 B2 * 12/2010 Masters ..... F15D 1/10 114/243
8,297,883 B2 10/2012 Masters et al.
8,511,245 B2 * 8/2013 Dehne ..... F16L 1/123 114/243
8,622,657 B2 1/2014 Masters et al.
8,770,894 B1 7/2014 Allen et al.
8,851,005 B2 10/2014 Tonchia
8,944,722 B1 * 2/2015 Allen ..... F16L 1/123 405/216
9,080,392 B1 6/2015 Allen et al.
9,511,825 B1 12/2016 Henning et al.
9,523,247 B1 12/2016 Allen et al.
9,523,456 B1 12/2016 Allen et al.
9,803,431 B1 10/2017 Allen et al.
2002/0074133 A1 6/2002 McMillan et al.
2003/0007839 A1 1/2003 Brown
2003/0074777 A1 4/2003 McMillan et al.
2004/0013473 A1 1/2004 Gibson
2005/0082730 A1 4/2005 Murray et al.
2005/0141967 A1 6/2005 Giles et al.
2006/0153642 A1 7/2006 Esselbruge et al.
2006/0231008 A1 10/2006 Allen et al.
2006/0280559 A1 12/2006 Allen et al.
2007/0140797 A1 6/2007 Armstrong
2007/0196181 A1 8/2007 Tryer et al.
2007/0296229 A1 12/2007 Chauvin et al.
2008/0025800 A1 1/2008 Watkins
2008/0050181 A1 2/2008 Masters et al.
2008/0131210 A1 6/2008 Wajnikonis
2008/0236469 A1 10/2008 Masters et al.
2009/0076529 A1 3/2009 Ganti
2009/0185867 A1 7/2009 Masters et al.
2009/0185868 A1 7/2009 Masters et al.
2009/0252559 A1 10/2009 Masters et al.
2010/0129159 A1 5/2010 Brown
2010/0156088 A1 6/2010 Masters et al.
2010/0181064 A1 7/2010 Knobloch et al.
2010/0215440 A1 8/2010 Wajnikonis
2011/0200396 A1 8/2011 Allen et al.
2012/0291687 A1 11/2012 Dehne et al.
2013/0014685 A1 1/2013 Tonchia
2013/0039702 A1 2/2013 West et al.
2013/0064607 A1 3/2013 Masters et al.
2015/0086276 A1 3/2015 Harbison et al.
2018/0100353 A1 4/2018 Allen et al.
2019/0218866 A1 * 7/2019 Allen ..... E21B 17/22

FOREIGN PATENT DOCUMENTS

GB 2362444 A 11/2001
WO WO 01/77563 A1 10/2001
WO WO2005026560 A1 3/2005
WO WO2007/106736 A2 9/2007
WO WO2008064102 A3 5/2008
WO WO2009070483 A1 6/2009
WO WO 2011/022332 A 2/2011
WO WO-2018231061 A1 * 12/2018 ..... F16L 1/123

OTHER PUBLICATIONS

Lee, L. et al., "Blade Henning Devices for VIV Supression of Offshore Tubulars", Proceedings of OMAE:28$^{th}$ International Conference on Ocean, Offshore and Arctic Engineering, Shell Global Solutions (US) Inc., May 31-Jun. 5, 2009, pp. 1-6.

* cited by examiner

METHODS FOR CONSTRUCTING A HELICAL STRAKE SEGMENT USING ONE OR MORE SHELL SECTIONS AND FINS

CROSS-REFERENCE TO RELATED APPLICATION

The application is a non-provisional application of U.S. Provisional Patent Application No. 62/618,046, filed Jan. 16, 2018, which is incorporated herein by reference.

FIELD

A helical strake segment including shell segments with, or without, discrete fins. Other embodiments are also described herein.

BACKGROUND

A difficult obstacle associated with the exploration and production of oil and gas is management of significant ocean currents. These currents can produce vortex-induced vibration (VIV) and/or large deflections of tubulars associated with drilling and production. VIV can cause substantial fatigue damage to the tubular or cause suspension of drilling due to increased deflections. A common device for suppressing VIV is a helical strake.

A helical strake may include a shell with fins attached to the shell in a helical arrangement to disrupt the flow. Helical strakes control the point at which the oncoming current separates from the helical strake thereby controlling, and shortening, correlation length of the vortex shedding. This decreased correlation length reduces VIV due to both weaker vortices and near random phasing of the various vortices that are shed along the tubular span.

SUMMARY

The present invention is directed to methods for fabricating a helical strake using discrete fins and/or with minimal mold costs. A recent development for constructing a helical strake is to eliminate the shell and simply band rigid fins to the tubular, also referred to as banded fins. These fins, however, are difficult to construct. In addition, helical strakes having a shell are often still required on a portion of the tubular in order to coat the fins and shell with a coating to inhibit marine growth. While it is possible to produce an entire mold when a large number of helical strakes having a shell are required, it can be cost prohibitive when the quantity required is moderate or low. Thus, the instant invention proposes a method for fabricating a helical strake with a shell when the quantity of fins is moderate or low, and optionally when banded fins for the same size tubular are already being constructed. The invention further contemplates a cost effective method for fabricating helical strakes having a shell utilizing discrete fins.

Representatively, in one aspect, the invention is directed to a helical strake for suppressing a vortex induced vibration (VIV) of a tubular. The helical strake may include a shell dimensioned to at least partially encircle an underlying tubular and having at least one fin opening, and at least one fin dimensioned to be positioned within the at least one fin opening formed by the shell. The at least one fin may have a base portion dimensioned to be positioned along an underlying tubular and a tail portion dimensioned to extend through the at least one fin opening and radially outward from an underlying tubular. In some aspects, the at least one fin opening is an elongated opening having a longitudinal opening axis that is at an angle to a longitudinal shell axis of the shell. The at least one fin may include a plurality of fin segments that extend from a first end to a second end of the shell, or may be a continuous fin that extends from a first end to a second end of the shell. The shell may include a plurality of fin openings, and the plurality of fin openings are helically arranged around the shell. In some aspects, the at least one fin may include a plurality of fins that are helically arranged around the underlying tubular when positioned within the plurality of fin openings. The shell may include a first shell member, a second shell member and a third shell member that form at least three fin openings circumferentially spaced around an underlying tubular. The first shell member, the second shell member and the third shell member may be separate structures that each include a center portion positioned along the underlying tubular and a pair of flanges extending radially outward from the center portion, and wherein the fin openings are formed between the flanges of adjacent ones of the first, second and third shell members. In some embodiments, the at least one fin is a T shaped fin and the base portion is wider than the at least one fin opening. In addition, the strake may include a slot formed through the at least one fin, the slot dimensioned to receive a band for securing the at least one fin and the shell to the underlying tubular.

In another aspect, the invention is directed to a helical strake for suppressing a vortex induced vibration (VIV) of a tubular including a shell dimensioned to at least partially encircle an underlying tubular, the shell having a plurality of circumferentially spaced fin openings formed through the shell, and a plurality of fins dimensioned to be positioned within the plurality of circumferentially spaced fin openings, and wherein the plurality of fins are in a helical arrangement when positioned within the fin openings. The shell may include a plurality of shell members that are connected together to completely encircle the underlying tubular. In some cases, at least one opening of the plurality of circumferentially spaced fin openings is an elongated opening extending between a first end and a second end of the shell, and at least one fin of the plurality of fins is a continuous fin. In still further aspects, at least two openings of the plurality of circumferentially spaced openings are helically arranged between a first end and a second end of the shell, and at least one fin of the plurality of fins comprises at least two discrete fin segments positioned in the at least two openings. The plurality of fins may have a triangular shape comprising a base portion that is wider than the plurality of openings and rests against an underlying tubular while a tail portion extends through the plurality of openings.

In still further aspects, the invention is directed to a helical strake for suppressing a vortex induced vibration (VIV) of a tubular including a shell comprising a plurality of shell members that are dimensioned to at least partially encircle an underlying tubular, the shell members having a center portion that conforms to a shape of the underlying tubular and a pair flanges that extend radially outward from opposite sides of the center portion, and wherein the pair of flanges of one of the shell members are dimensioned to align with the pair of flanges of adjacent shell members to form a plurality of helical extension member along the underlying tubular. In some embodiments, the plurality of circumferentially spaced fin openings are formed between the flanges of the plurality of shell members, and the strake further comprises a plurality of fins dimensioned to be positioned within the plurality of circumferentially spaced fin openings. The flanges may conform to a shape of the plurality of fins positioned within the plurality of circumferentially spaced fin openings and hold the fins against an underlying tubular. Each of the plurality of fins may include a base portion that is positioned between the shell and the underlying tubular and a tail portion that extends through the plurality of fin opening. A fastener may be used to secure the flanges to each other or the plurality of fins.

The above summary does not include an exhaustive list of all aspects of the present invention. It is contemplated that the invention includes all apparatuses that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments disclosed herein are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section, we shall explain several preferred embodiments with reference to the appended drawings. Whenever the shapes, relative positions and other aspects of the parts described in the embodiments are not clearly defined, the scope of the embodiments is not limited only to the parts shown, which are meant merely for the purpose of illustration. Also, while numerous details are set forth, it is understood that some embodiments may be practiced without these details. In other instances, well-known structures and techniques have not been shown in detail so as not to obscure the understanding of this description.

The terminology used herein is for the purpose of describing particular aspects only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1A:
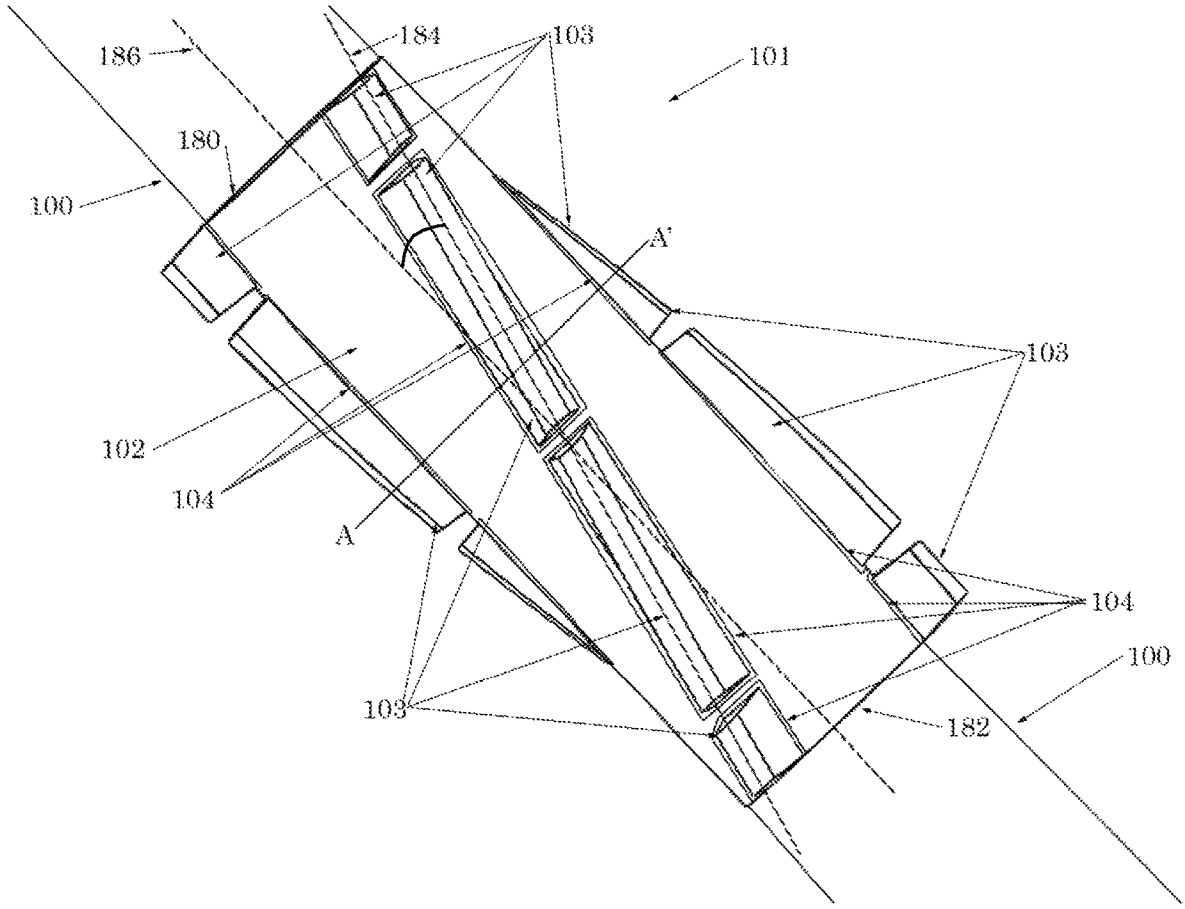
FIG. 1A is a side view of a helical strake segment consisting of a shell and discrete fins.

Referring now to the invention in more detail, FIG. 1A shows side perspective view of a helical strake segment 101 around tubular 100. Helical strake segment 101 is made up of shell 102 and fins 103 extending through openings 104 in shell 102. Openings 104 are dimensioned to receive fins 103. Fins 103 may extend in a helical arrangement between a first end 180 and a second end 182 of shell 102. Fins 103 may be discrete fins that are inserted through openings 104. In other words, fins 103 are separate structures from one another, and shell 102, prior to assembly of strake section 101. Shell 102 is a cylindrical (or nearly cylindrical) structure that has openings 104 cut out of the structure to allow for insertion of fins 103. Any number of openings 104 and fins 103 may be present. The openings 104 and fins 103 may be in a helical arrangement along shell 102. For example, openings 104 and/or fins 103 may be elongated members having a longitudinal axis 184, which is at an angle to, or otherwise not parallel to, the longitudinal axis 186 of shell 102, such that when fins 103 are positioned within openings 104, they are helically arranged along shell 102. Fins 103 may be discrete segments such that gaps are formed between adjacent fins or may be made more continuous including fins 103 that extend through the entire length, or nearly the entire length, of helical strake segment 101 and shell 102 without gaps between adjacent fins.

Still referring to FIG. 1A, any number of fins 103 may be present and any number of fins may be present around the circumference at any axial location of shell 102 or helical strake segment 101. Fins 103 may be separated by any suitable gap along a single helix and may be separated by any angle or length along the circumference of shell 102 or helical strake segment 101. Fins 103 may be of any suitable geometry including, but not limited to, T-shaped, round, oval, trapezoidal, rectangular, triangular, or any variation or combination thereof. Fins 103 may be any combination of straight and rounded sides. Fins 103 on a given helical strake segment 101 or shell 102 may all be the same of may be different, even along a single helix. Once inserted through openings 104, fins 103 may be attached to shell 102 by any suitable means including, but not limited to, chemical bonding, fastening with nuts, bolts, rivets, clamps, or other mechanical means, and welding. In some embodiments, however, the base of fins 103 under shell 102, are larger than the associated openings 104. Fins 103 can therefore be sufficiently restrained against shell 102, once helical strake segment 101 is attached to, or banded to, tubular 100, without any additional attachment means between fins 103 and shell 102.

Helical strake segment 101 may be attached to tubular 100 by any suitable means including, but not limited to, banding, clamping, fastening, chemical bonding, or by the use of other intermediate structures. Shell 102 and fins 103 may have coatings or other structures on their interior or their exterior, or both their interior and their exterior, such as anti-fouling coatings or copper (or copper alloy) bar. Helical strake segment 101 may be of any suitable length, diameter, or cross section. Shell 102 may have any suitable length, diameter, or cross section and may have a cross section that varies along its length. Fins 103 may have openings for bands, springs, or other structures. Shell 102 may have openings for bands, springs, or other structures. Shell 102 and fins 103 may have openings for other reasons such as for heat transfer from or to the underlying structure or to improve the performance of an underlying cathodic protection coating, system, or structure. Shell 102 may have indentations so that part of shell 102 is spaced off of tubular 100. Openings 104 may be of any suitable size or shape.

Still referring to FIG. 1A, shell 102 and fins 103 may be made of any suitable material including, but not limited to, plastic, metal, fiberglass, composite, synthetic, rubber or elastomer, and wood. Shell 102 and fins 103 may be made of the same material or may be made of different materials. Materials may be mixed or matched as suitable for helical strake segment 101 and its components.

Figure 1B:
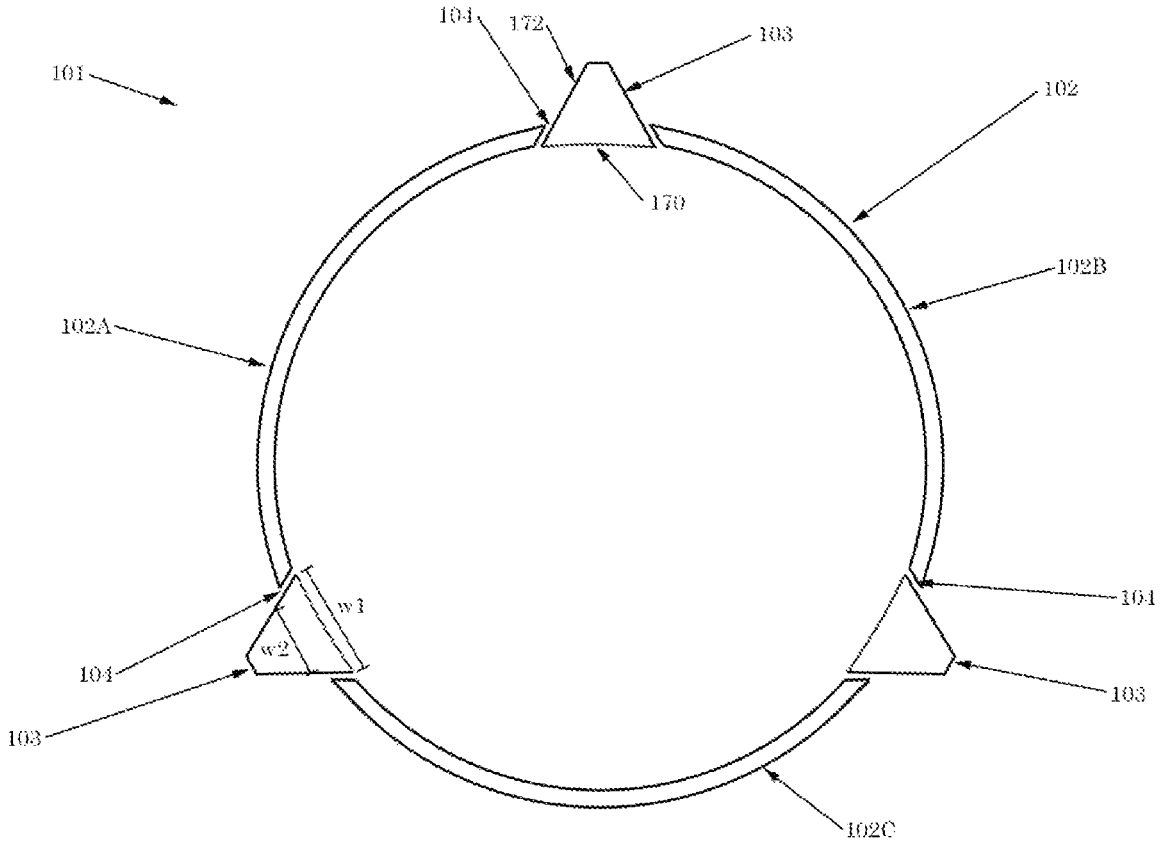
FIG. 1B is cross section A-A' of Fig. la and shows a helical strake segment consisting of a shell and discrete fins.

Referring now to FIG. 1B, FIG. 1B a cross sectional end view of helical strake segment 101 of FIG. 1A. Helical strake segment 101 may include shell 102, which is made up of shell members 102A, 102B, and 102C, and fins 103 extending through openings 104. From this view, it can be seen that fins 103 extend through openings 104 in shell 102 that may, or may not, be wider than the base of fins 103. For example, in some embodiments, fins 103 may have a base portion 170 and a tail portion 172 that extends from the base portion. The base portion 170 may have a width dimension (W1) that is larger than a width dimension (W2) of opening 104. In this aspect, the base portion 170 does not fit through opening 104 and is held against the tubular by the shell 102, while the tail portion 172 extends through opening 104, and radially outward from the base portion and tubular (and the shell portion surrounding the tubular). Shell members 102A, 102B and 102C may be attached to one another, or separate from one another. For example, if fins 103 are formed by separate fin segments extending from one end to another of strake segment 101 as shown in FIG. 1A, shell members 102A-102C may be attached to another between the fin segments. Alternatively, if fins 103 are continuous, that is if fins 103 are continuous from one end to another of helical strake segment 101 in FIG. 1A, then shell members 102A, 102B, and 102C can be discrete members that are optionally attached to fins 103 by any suitable means.

Figure 1C:
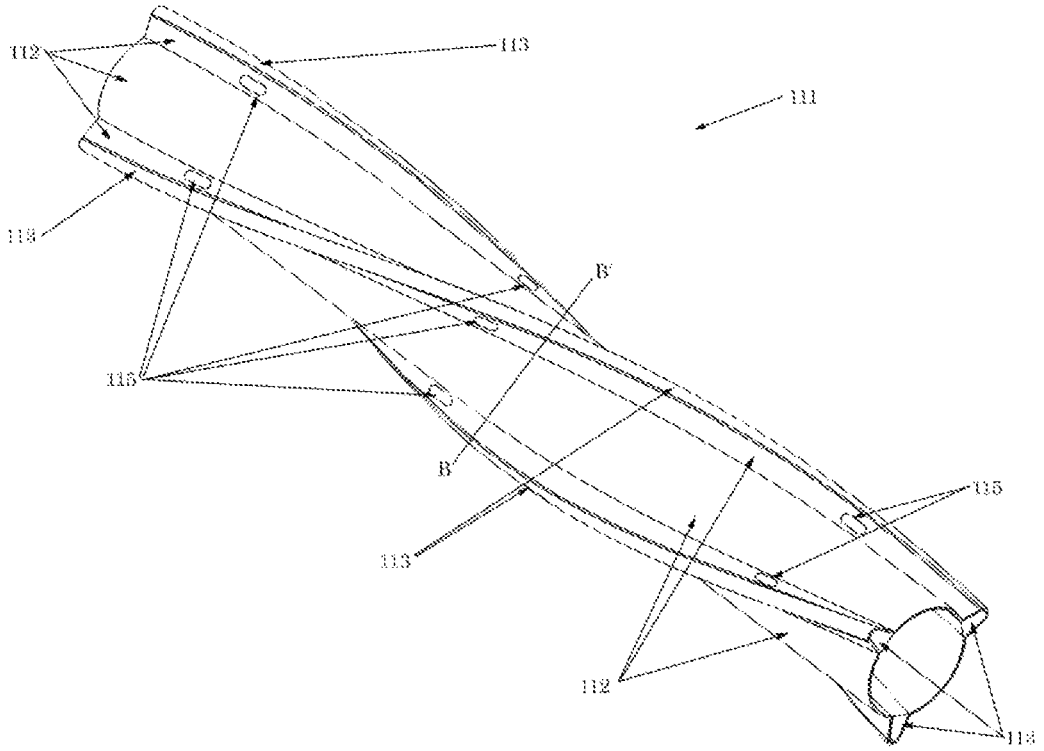
FIG. 1C is a perspective view of a helical strake segment having discrete fins and adjoining shell members.

Referring now to FIG. 1C, FIG. 1C shows a side perspective view of another embodiment of a helical strake. Representatively, helical strake segment 111 is shown including shell members 112 and fins 113 with slots 115 extending through shell members 112 and fins 113. Shell members 112 may extend both between adjacent fins 113 and also along at least part of the surface of fins 113. If shell members 112 extend along the sides of fins 113 that project away from the surface of the underlying tubular (not shown), then slots 115 will extend through both shell members 112 and fins 113. However, it is not necessary for shell members 112 to extend along the sides of fins 113 that project away from the surface of the underlying tubular, for example fins 113 can have base members that are extend circumferentially and thus shell members 112 can be attached to those base members leaving slots 115 to travel only through fins 113.

Still referring to FIG. 1C, shell members 112 may be optionally attached to fins 113 by any suitable means including, but not limited to, chemical bonding, fastening with nuts, bolts, rivets, clamps, or other mechanical means, and welding. Any number of slots 115 may be present and slots 115 may be of any suitable shape or size. Springs or other structures may be present in slots 115, shell members 112, or fins 113. Shell members 112 and fins 113 may be made of the same material or may be made of different materials. Materials may be mixed or matched as suitable for helical strake segment 111 and its components.

Figure 1D:
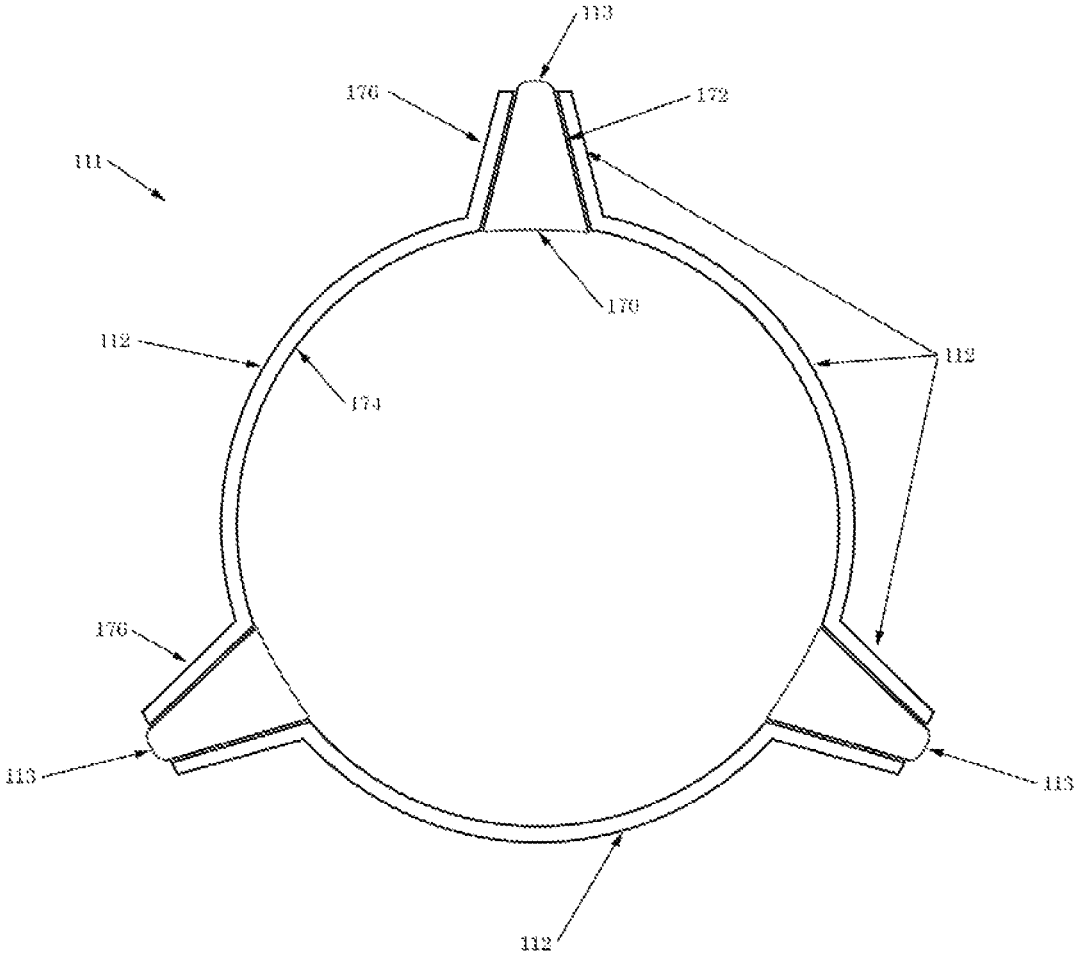
FIG. 1D is cross section B-B' of FIG. 1C and shows a helical strake segment with discrete fins and adjoining shell members.

Referring now to FIG. 1D, FIG. 1D is a cross sectional end view of FIG. 1C along line B-B'. From this view, the strake segment 111 with shell members 112 and fins 113 can be more clearly seen. Representatively, from this view it can be seen that fins 113 have a trapezoidal cross section with curved tops. For example, fins 113 may have a base portion 170, which is held against the tubular by the shell member 112, and a tail portion 172, which extends radially outward to the tubular portion (and the shell portion surrounding the tubular) and is curved at the top. The base portion 170 may be optionally curved for example to match the curvature of the underlying tubular. Shell members 112 may include a center portion 174, which matches the curvature of the underlying tubular and rests on the tubular, and which is flanked by flanges or extension members 176. The flanges or extension members 176 of adjacent shell members 112 may form openings or gaps that the fins 113 can be positioned within or between. The flanges or extension members 176 may extend up the sides of the adjacent fins 113 and help to hold the fins 113 against the tubular. Shell members 112 may be optionally attached to fins 113 by any suitable means including, but not limited to, chemical bonding, fastening with nuts, bolts, rivets, clamps, or other mechanical means, taping, and welding. Attachment of shell members 112 to fins 113 may be temporary, for example for transportation or for installation, or may be permanent through the life of helical strake segment 111. While FIG. 1D shows three fins 113 and three shell members 112 present, any number of fins 113 and shell members 112 may be present on helical strake segment 111.

Figure 1E:
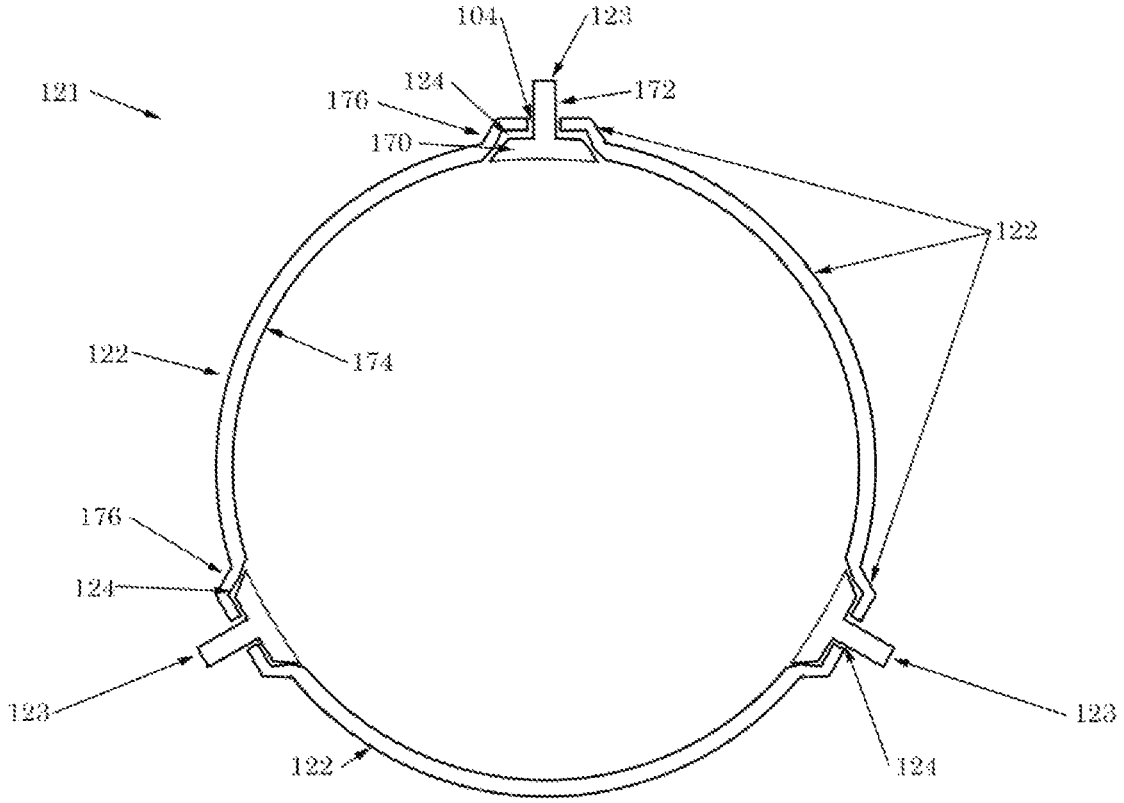
FIG. 1E is a cross section of a helical strake showing T-shaped fins and adjoining shell members.

Referring now to FIG. 1E, FIG. 1E shows a cross-sectional end view of a strake segment similar to FIG. 1C, except in this embodiment, helical strake segment 121 includes different cross sections for shell members 122 and fins 123. Fins 123 extend through openings between, or in, shell members 122, as previously discussed.

Representatively, in this embodiment, fins 123 are T-shaped in cross section and the ends (flanges) of shell members 122 are made to approximately match at least part of the T-shaped cross section. Fins 123 may have other similar shapes, for example fins 123 may have a base portion 170, such as the base of the inverted T in FIG. 1E, with a vertical member or tail 172 that is not necessarily rectangular. Thus, fins 123 may be of any suitable cross section with a surface to mate with an adjacent shell member 122.

Note that shell members 122 may have other openings for other fins or other structures. Shell members 122 may have other end shapes than those shown in FIG. 1E; in general shell members 122 will either have at least one surface that provides interference for fins 123 being pulled outward when an underlying tubular is present or have at least once surface for attaching shell member 122 to an adjacent fin 123. Openings 124 may be of any suitable shape. In FIG. 1E openings 124 are not straight but are rather somewhat S-shaped.

Figure 1F:
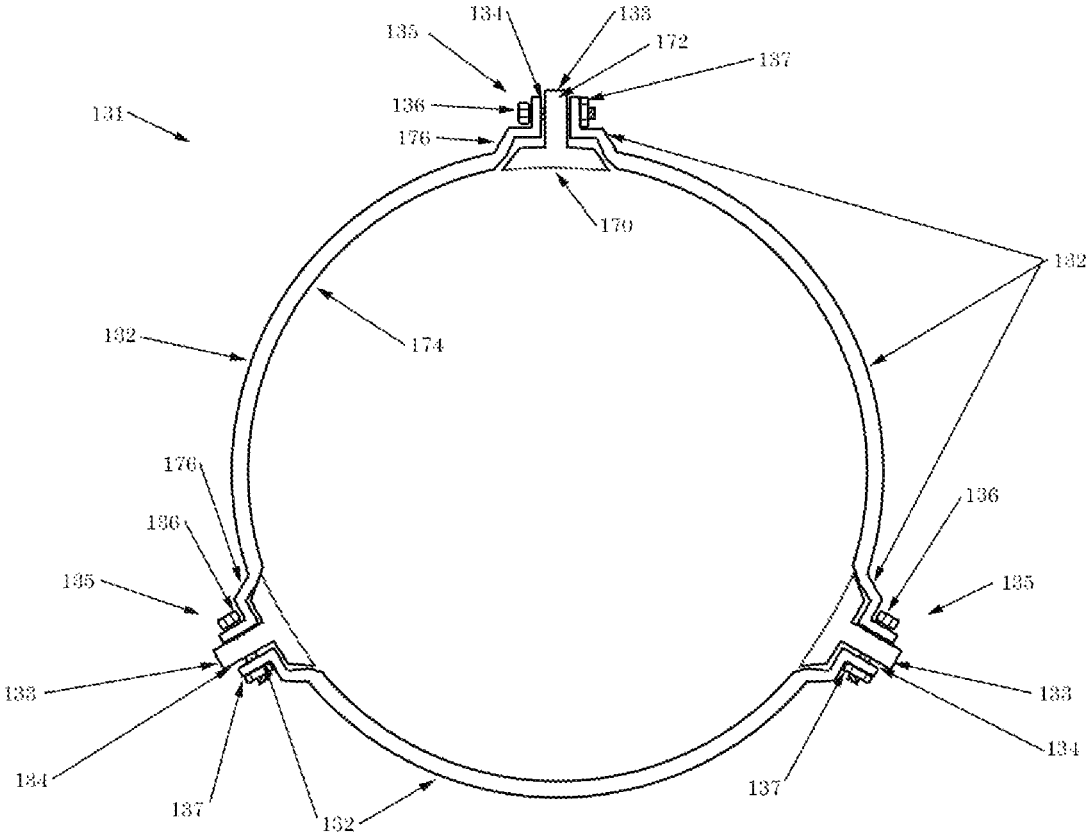
FIG. 1F is a cross section of a helical strake showing T-shaped fins and adjoining shell members with the fins fastened to the shell members.

Referring now to FIG. 1F, FIG. 1F shows a cross-sectional end view similar to FIG. 1E, and includes helical strake segment 131 with fins 133 extending through openings 134 between, or in, shell members 132. In this embodiment, however, fasteners 135, consisting of bolts 136 and nuts 137, are further shown attaching fins 133 to shell members 132. Representatively, fasteners 135 may include bolts 136 which extend entirely through the flange portions of shell members 132 extending up the fins 133, and portions of fins 133 between the flange portions. The nuts 137 may be attached to the end of the bolts 136 extending out of the flange portions.

Fasteners 135 can be any type of fasteners suitable for attaching, or connecting, fins 133 to shell members 132. Representatively, fasteners 135 can include, but are not limited to, fastening with nuts, bolts, rivets, clamps, or other mechanical means, taping, welding or chemical bonding. Any number of fasteners 135 may be used for a single fin 133 or shell member 132 and fasteners 135, bolts 136, and nuts 137 may be of any size, shape, or quantity. Fasteners 135, bolts 136, and nuts 137 may be made of the same material or may be made of different materials.

Figure 1G:
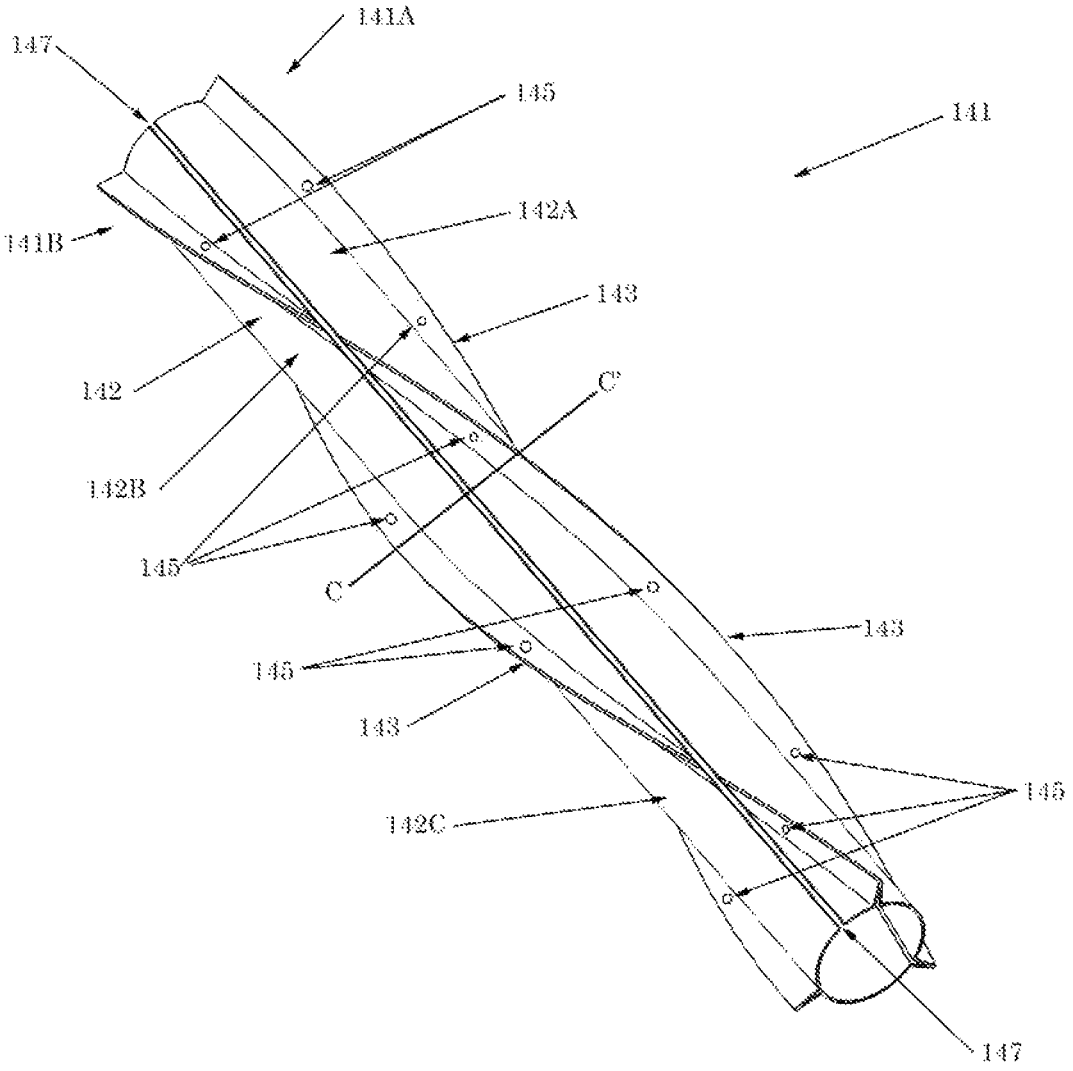
FIG. 1G is a perspective view of a helical strake segment made up of adjoining shell members and having a single split for fitting around a tubular.

Referring now to FIG. 1G, FIG. 1G illustrates a perspective view of another embodiment of a helical strake segment. Helical strake segment 141 may include a shell 142 and fins 143. In this embodiment, helical strake segment 141 has slit 147 running along the length of segment 141, thus forming opposing helical strake sides 141A and 141B, which when brought together, encircle the underlying tubular. Slit 147 may be a substantially straight slit (or gap) formed through shell 142 and fins 143 as shown. Shell 142 may include shell members 142A, 142B, and 142C that are attached to each other using rivets 145. As can be seen from FIG. 1H, shell members 142A-142C may include a center portion 174, flanked by flanges 143, which form helically shaped extension members or fins 143, and are attached to each other using rivets 145.

Shell members 142A, 142B, and 142C each extend around part of the circumference of helical strake segment 141. Each of shell members 142A, 142B an 142C may have edges that are raised (and extend away from the underlying tubular) and helical in shape so that edges of adjacent shell members 142A, 142B, and 142C can be adjoined to form helical strake segment 141 and the edges of adjacent shell members 142A, 142B, and 142C form the fins 143 of helical strake segment 141. Any number of shell members 142A, 142B, and 142C may be present and openings may be present in shell members 142A, 142B, and 142C with these openings used for any suitable purpose. For example, gaps in the edges of shell members 142A, 142B, and 142C may be used as channels for bands in fins 143 and may even contain springs for bands so as to accommodate changes in diameter of the underlying tubular. While FIG. 1G shows rivets 145 used to connect adjacent shell members 142A, 142B, and 142C, any suitable connection method may be used including, but not limited to, chemical bonding, fastening with nuts, bolts, rivets, clamps, or other mechanical means, taping, and welding. Fins 143 may be of any suitable height, shape, and thickness and do not need to be of constant height along their length.

Still referring to FIG. 1G, shell members 142A, 142B, and 142C and rivets 145 may be made of any suitable material including, but not limited to, plastic, metal, fiberglass, composite, synthetic, rubber or elastomer, and wood. Materials may be mixed or matched as suitable for helical strake segment 141 and its components.

Figure 1H:
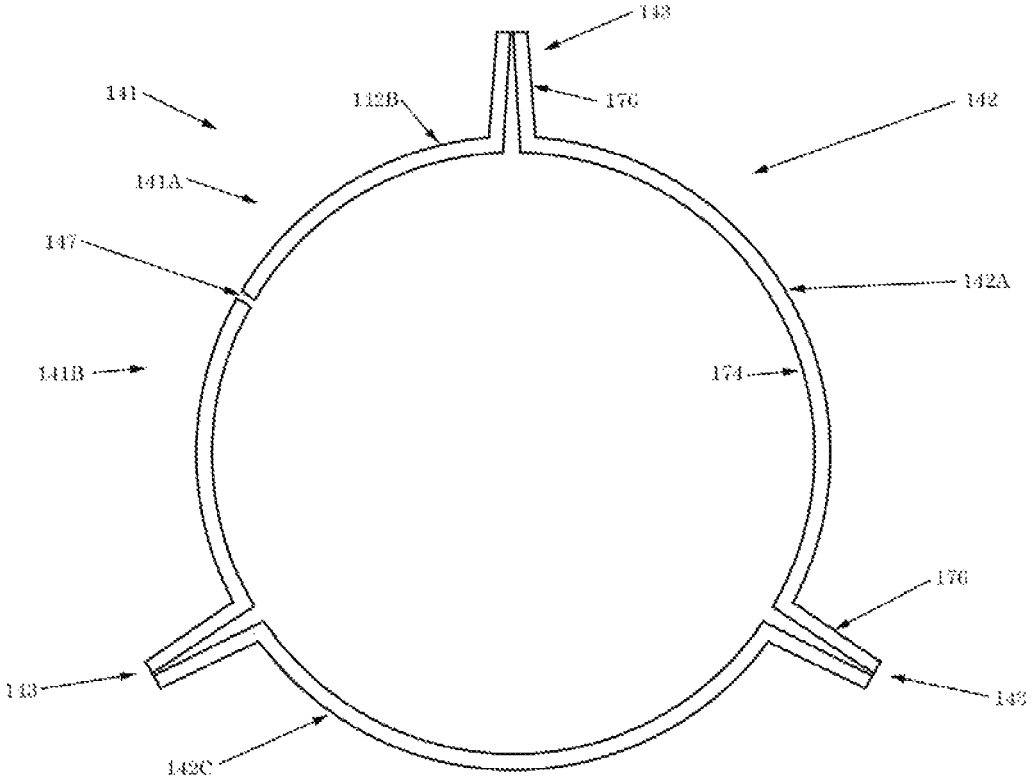
FIG. 1H is cross section C-C' of FIG. 1G showing a helical strake section made up of adjoining shell members and having a single split for fitting around a tubular.

Referring now to FIG. 1H, FIG. 1H shows a cross-sectional end view along line C-C' of FIG. 1G. From this view, the arrangement of helical strake segment 141 with shell members 142A, 142B, and 142C forming both shell 142 and fins 143 can be more clearly seen. Helical strake sides 141A and 141B sit opposite slit 147 which allows helical strake segment 141 to be opened and closed around an underlying tubular such as tubular 100 in FIG. 1A.

Still referring to FIG. 1H, any number of slits 147 may be present and thus helical strake segment 141 may consist of any number of circumferential sections. This feature applies to all of the helical strake segments described in this specification. While FIG. 1H shows the edges of shell members 142A, 142B, and 142C approaching adjacent edges with a taper, thereby forming a trapezoidal fin 143, these edges may be of any suitable geometry. For example, edges of shell members 142A, 142B, and 142C may form rectangular fins and helical strake segment 141 may have fins of various geometries by modifying the edges of shell members 142A, 142B, and 142C by any suitable means.

Figure 1I:
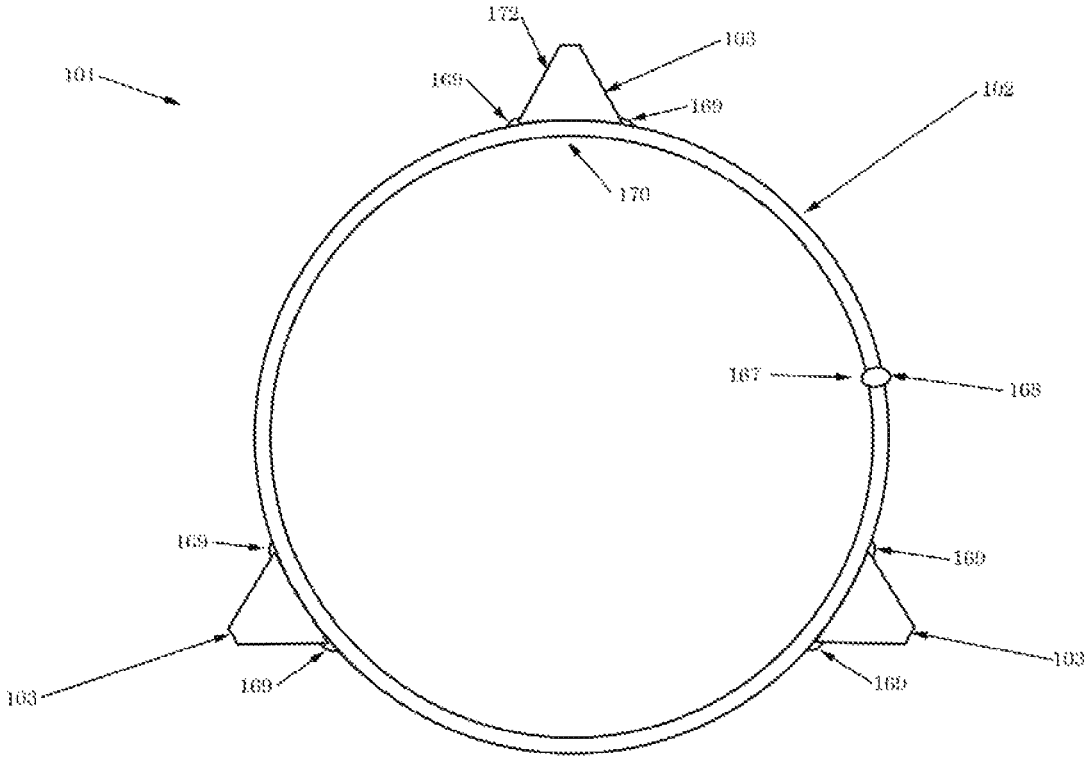
FIG. 1I is cross section of another embodiment of a helical strake.

FIG. 1I is cross section of another embodiment of a helical strake. Representatively, FIG. 1I shows a helical strake segment 101 including a shell 102 and fins 103. The shell 102, in this embodiment, may be made from a continuous sheet of material. The sheet of material may be a relatively flat and relatively flexible sheet of material that can be wrapped around the underlying tubular (not shown). Once wrapped around the tubular, the interfacing edges 167 of the sheet of material maybe secured together at attachment region 168. For example, the interfacing edges 167 may be welded, taped, or otherwise secured together. In some cases, the interfacing edges 167 may be temporarily secured together. In particular, as will be discussed in more detail below, in some aspects fins 103 may be stiff enough to hold the shell 102 around the tubular, once they are positioned around the shell 102.

The fins 103 may be similar to the previously discussed fins in that they can include a base portion 170 and tail portion 172. In this embodiment, the base portion 170 may be positioned on the outer surface of the shell 102. For example, the base portion 170 can be connected to the shell 102 at attachment region 169, which could be a weld joint. The fins 103 can be attached to the shell 102 before or after securing the shell 102 around the tubular. For example, in one aspect, the shell 102 is closed and secured at point 168 around the tubular, and then the fins 103 can be attached to the outer surface of the shell 102. It should further be recognized that in some aspects, the fins 103 are stiff or rigid enough to maintain a helical configuration on their own around a tubular and therefore do not need to be welded to the shell, or otherwise secured to the shell by another piece. Instead, once the shell 102 is positioned around the tubular, the fins 103 can be positioned around the shell 102 and will remain in place without welding. The fins 103 may also help hold the shell 102 around the tubular, without welding the fins 103 to the shell 102, due to their stiff or rigid helical shape.

Figure 1J:
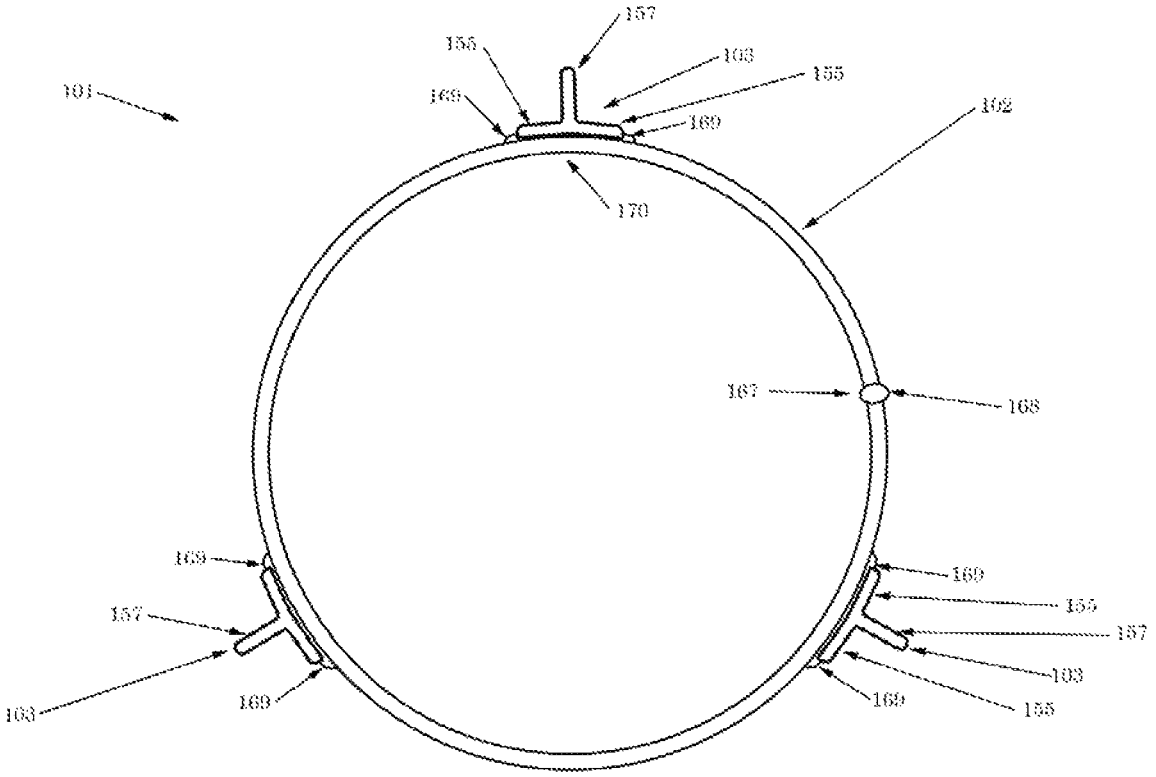
FIG. 1J is cross section of another embodiment of a helical strake.

FIG. 1J is cross section of another embodiment of a helical strake. Representatively, FIG. 1J shows a helical strake segment 101 including a shell 102 and fins 103. The shell 102, in this embodiment, may be similar to the shell described in reference to FIG. 1I in that it is made from a continuous sheet of material. The sheet of material may be a relatively flat sheet of material that can be wrapped around the underlying tubular (not shown). The interfacing edges 167 of the sheet of material may be secured together (e.g., welded) at attachment region 168 as previously discussed. The fins 103 can be attached to the shell 102 before or after securing the shell 102 around the tubular.

The fins 103 may be similar to the previously discussed fins, except in this embodiment fins 103 may have a T shape. Representatively, fin 103 may include a base portion 170 made up of flanges 155, and a tail portion 157 that is perpendicular to the flanges 155 of base portion 170 such that they form a T shape. The flanges 155 (or widest portion of the fin) are attached (e.g., welded) to the outer surface of the shell 102 at attachment regions 169, as previously discussed. It should further be recognized that in some aspects, the fins 103 are stiff enough to maintain a helical configuration on their own around a tubular and therefore do not need to be welded to the shell. Instead, once the shell 102 is positioned around the tubular, the fins 103 can be positioned around the shell 102 and will remain in place without welding. The fins 103 may also help hold the shell 102 around the tubular, without welding the fins 103 to the shell 102, due to their stiff or rigid helical shape.

In broad embodiments, the present invention is directed to a helical strake segment including shell segments with, or without, discrete fins. The above aspects of this invention may be mixed and matched in any manner suitable to achieve the purposes of this invention. Other appurtenances for connecting various components may be utilized and each component may be manufactured by any suitable means. One or more anti-fouling coatings or structures may be applied to the inner surface, the outer surface, or both the inner and outer surface of any of the helical strake segments or components described herein. Each helical strake segment may have any number of slits and may be divided circumferentially into any number of section in any suitable manner including sections that are helical in shape. Attachments may be temporary such as for storage or installation or may be more permanent for field use. The helical strake sections may be attached around an underlying tubular by any suitable means including, but not limited to, banding, bolting, clamping, and chemical bonding.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. For several of the ideas presented herein, one or more of the parts may be optional. The invention should therefore not be limited by the above described embodiment, method, and examples, but by all embodiments and methods within the scope and spirit of the invention.

What is claimed is:

1. A helical strake for suppressing a vortex induced vibration (VIV) of a tubular, the helical strake comprising:

a shell dimensioned to at least partially encircle an underlying tubular, the shell having at least one shell wall that defines a fin opening; and at least one fin dimensioned to be positioned through the at least one fin opening formed by the shell, the at least one fin having a base portion dimensioned to be positioned along an underlying tubular and a tail portion dimensioned to extend through the at least one fin opening and radially outward from an underlying tubular and the shell, and wherein the fin comprises a length dimension and a width dimension that is less than the length, and the width dimension tapers continuously from the base portion to an end of the tail portion.

2. The helical strake of claim 1 wherein the fin opening comprises an elongated opening having a longitudinal opening axis that is at an angle to a longitudinal shell axis of the shell.

3. The helical strake of claim 1 wherein the at least one fin comprises a plurality of fin segments that extend from a first end to a second end of the shell.

4. The helical strake of claim 1 wherein the at least one fin comprises a continuous fin that extends from a first end to a second end of the shell.

5. The helical strake of claim 1 wherein the shell comprises a plurality of fin openings that extend from an inner surface of the shell facing the tubular to an outer surface of the shell facing away from the tubular, and the plurality of fin openings are helically arranged around the shell.

6. The helical strake of claim 5 wherein the at least one fin comprises a plurality of fins that are helically arranged around the underlying tubular when positioned within the plurality of fin openings.

7. The helical strake of claim 1 wherein the shell comprises a first shell member, a second shell member and a third shell member that form at least three fin openings circumferentially spaced around an underlying tubular.

8. The helical strake of claim 7 wherein the first shell member, the second shell member and the third shell member are separate structures that each comprise a center portion positioned along the underlying tubular and a pair of flanges extending radially outward from the center portion, and wherein the fin openings are formed between the flanges of adjacent ones of the first, second and third shell members.

9. The helical strake of claim 1 further comprising a slot formed through the at least one fin, the slot dimensioned to receive a band for securing the at least one fin and the shell to the underlying tubular.

10. A helical strake for suppressing a vortex induced vibration (VIV) of a tubular, the helical strake comprising:

a shell dimensioned to at least partially encircle an underlying tubular, the shell having a plurality of circumferentially spaced fin openings formed through the shell; and a plurality of fins dimensioned to be positioned through the plurality of circumferentially spaced fin openings such that a tail portion of each of the plurality of fins is exposed through the fin openings and a base portion rests against an underlying tubular, wherein each of the plurality of fins have a width dimension that is less than a length dimension, and the width dimension of each of the plurality of fins tapers continuously from the base portion to an end of the tail portion, and wherein the plurality of fins are in a helical arrangement when positioned through the fin openings.

11. The helical strake of claim 10 wherein the shell comprises a plurality of shell members that are connected together to completely encircle the underlying tubular.

12. The helical strake of claim 10 wherein at least one opening of the plurality of circumferentially spaced fin openings is an elongated opening extending between a first end and a second end of the shell, and at least one fin of the plurality of fins is a continuous fin.

13. The helical strake of claim 10 wherein at least two openings of the plurality of circumferentially spaced openings are helically arranged between a first end and a second end of the shell, and at least one fin of the plurality of fins comprises at least two discrete fin segments positioned in the at least two openings.

14. The helical strake of claim 10 wherein a shape of a cross-section of the plurality of fins along the width dimension is a triangular shape and the widest part of the triangular shape is wider than the plurality of openings.

* * * * *